US008079698B2

(12) United States Patent
Nakayama

(10) Patent No.: US 8,079,698 B2
(45) Date of Patent: Dec. 20, 2011

(54) INKJET RECORDING APPARATUS

(75) Inventor: Koji Nakayama, Seki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1181 days.

(21) Appl. No.: 11/782,725

(22) Filed: Jul. 25, 2007

(65) Prior Publication Data

US 2008/0024581 A1 Jan. 31, 2008

(30) Foreign Application Priority Data

Jul. 31, 2006 (JP) ..... 2006-207833
Jul. 31, 2006 (JP) ..... 2006-208692

(51) Int. Cl.
*B41J 2/01* (2006.01)

(52) U.S. Cl. ..... 347/104; 399/110

(58) Field of Classification Search ..... 347/25, 347/34, 102–104
See application file for complete search history.

(56) References Cited

U.S. PATENT DOCUMENTS

| | | | | |
|---|---|---|---|---|
| 6,419,411 | B1 | 7/2002 | Tanno | |
| 6,725,776 | B2 | 4/2004 | Takata | |
| 2004/0141041 | A1 * | 7/2004 | Tsutsumi et al. | 347/102 |
| 2005/0019073 | A1 * | 1/2005 | Hattori | 399/388 |
| 2006/0098074 | A1 | 5/2006 | Nakashima | |

FOREIGN PATENT DOCUMENTS

| | | | | |
|---|---|---|---|---|
| JP | 59100737 | U | * | 7/1984 |
| JP | 01141075 | A | * | 6/1989 |
| JP | H11-41075 | A | | 6/1989 |
| JP | H1286879 | A | | 11/1989 |
| JP | 04053752 | A | * | 2/1992 |
| JP | H04-053752 | A | | 2/1992 |
| JP | 2002311669 | A | | 10/2002 |
| JP | 2003165230 | A | * | 6/2003 |
| JP | 2005082294 | A | | 3/2005 |
| JP | 2006131353 | A | | 5/2006 |

OTHER PUBLICATIONS

Notification of Reasons for Refusal for a Japanese Patent Application No. 2006-207833, dated May 15, 2008.

* cited by examiner

*Primary Examiner* — Charlie Peng
*Assistant Examiner* — Peter Radkowski
(74) *Attorney, Agent, or Firm* — Baker Botts L.L.P.

(57) ABSTRACT

There is disclosed an inkjet recording apparatus including a feeding device, a remover, and an inkjet head. The feeding device feeds a recording medium along a feed path passing through a removing area. A part of an opposingly-feeding surface extends opposed to the ink jet head and along the feed path, and the removing area is located under the opposingly-feeding surface and within the opposingly-feeding surface as seen in a vertical direction. The remover removes foreign matter from a surface of the recording medium during the recording medium is fed through the removing area by the feeding device. The inkjet head is disposed downstream of the remover with respect to a feeding direction in which the recording medium is fed. The inkjet head has an ink ejection surface in which a nozzle is open, and an ink droplet is ejected from the nozzle toward a recording surface of the recording medium while the recording medium is fed along at least a part of the opposingly-feeding surface.

19 Claims, 4 Drawing Sheets

INKJET RECORDING APPARATUS

CROSS REFERENCE TO RELATED APPLICATION

The present application claims priority from Japanese Patent Application Nos. 2006-208692 and 2006-207833, both of which were filed on Jul. 31, 2006, the disclosure of which is herein incorporated by reference in its entirety.

BACKGROUND OF THE INVENTION

1. Field of the Invention

The present invention relates to an inkjet recording apparatus for forming or recording an image on a recording medium.

2. Description of Related Art

An inkjet printer as a type of the inkjet recording apparatus is disclosed in JP-A-2006-131353. The inkjet printer includes an inkjet head, a feeder belt, and a medium holder. The inkjet head has an ink ejection surface in which openings of a plurality of nozzles are arranged, and the medium holder is capable of accommodating a stack of recording media, which may be cut sheets of paper. Recording media stacked on the medium holder are one by one picked up from the medium holder and fed by the feeder belt to a position to be opposed to the ink ejection surface of the inkjet head. When each recording medium reaches this position, droplets of ink are ejected from the nozzle openings to form an image on the recording medium.

It is often the case that foreign matter, such as paper dust, is present on a recording medium. Further, a recording medium is subject to an external force or vibrations while fed inside the printer. Hence, it may occur that during a recording medium is fed to the position to be opposed to the ink ejection surface after picked up from the medium holder, foreign matter on a surface of the recording medium departs from the surface and scatters around. Some of the foreign matter thus scattering may waft around the feeder belt and land on the ink ejection surface of the inkjet head, leading to closure of the nozzle openings or entrance of the foreign matter into the nozzles, which causes defect or failure in ejection of ink droplets. A remover can be disposed near the inkjet head in order to remove the foreign matter on the surface of the recording medium. However, it is impossible to perfectly remove the foreign matter from the surface of the recording medium with the remover, and a portion of the foreign matter inevitably scatters around. It is difficult to reliably inhibit the wafting foreign matter from landing on the ink ejection surface.

SUMMARY OF THE INVENTION

This invention has been developed in light of the above-described situations, and it is an object of the invention, therefore, to provide an inkjet recording apparatus which can reliably inhibit that foreign matter scattering from a surface of a recording medium lands on an ink ejection surface.

To attain the above object, the invention provides an inkjet recording apparatus including a feeding device, a remover, and an inkjet head. The feeding device feeds a recording medium along a feed path passing through a removing area. An opposingly-feeding surface at least a part of which is opposed to the ink ejection surface extends along the feed path, and the removing area is located under the opposingly-feeding surface and within the opposingly-feeding surface as seen in a vertical direction. The remover removes foreign matter from a surface of the recording medium during the recording medium is fed through the removing area by the feeding device. The inkjet head is disposed downstream of the remover with respect to a feeding direction in which the recording medium is fed. The inkjet head has an ink ejection surface in which a nozzle is open, and an ink droplet is ejected from the nozzle toward a recording surface of the recording medium while the recording medium is fed along the part of the opposingly-feeding surface.

Since the removing area is located under the opposingly-feeding surface as well as within the opposingly-feeding surface as seen in a vertical direction, the foreign matter, which scatters from the recording medium upon the removal at the removing area and wafts, is inhibited from entering a clearance between the opposingly-feeding surface and the ink ejection surface. Thus, the wafting foreign matter is reliably inhibited from landing on the ink ejection surface.

A first preferable form of the inkjet recording apparatus is such that the opposingly-feeding surface is a planar surface having a greatest area among all the planar surfaces extending along the feed path.

A second preferable form of the inkjet recording apparatus is such that the whole remover is located within the opposingly-feeding surface as seen in the vertical direction.

According to this form, the inkjet recording apparatus can be downsized.

A third preferable form of the inkjet recording apparatus is such that the opposingly-feeding surface is horizontal, and the recording surface of the recording medium does not once face vertically upward at a segment of the feed path between the removing area and the opposingly-feeding surface.

According to this form, the foreign matter scattering from the recording surface of the recording medium does not tend to land back on the recording surface, at the segment of the feed path between the removing area and the opposingly-feeding surface. Hence, less foreign matter is introduced to the opposingly-feeding surface. Thus, landing of foreign matter on the ink ejection surface is further reliably inhibited.

A fourth preferable form of the inkjet recording apparatus further includes a recording-area cover which covers at least the inkjet heads and a portion of the opposingly-feeding surface which portion is opposed to the ink ejection surface of the inkjet head.

According to this form, the foreign matter is further reliably inhibited from landing on the ink ejection surface.

A fifth preferable form of the inkjet recording apparatus further includes a removing-area cover which covers at least the remover and the removing area.

According to this form, the foreign matter departing from the recording medium is prevented from scattering around.

A sixth preferable form of the inkjet recording apparatus is such that the medium supply device includes a medium holder which accommodates a stack of the recording media, and an upper surface of each of the stack of the recording media is the recording surface from which the foreign matter is removed by the remover.

Foreign matter or dust may be accumulated on the topmost one of the stack of the recording media while the inkjet recording apparatus is not in use. According to this form, such foreign matter or dust is removed by the remover.

A seventh preferable form of the inkjet recording apparatus is such that the medium supply device includes a medium holder and a pickup roller. The medium holder accommodates a stack of the recording media. The pickup roller rotates in contact with a surface of a topmost one of the stack of the recording media in the medium holder in order to supply the topmost recording medium, the surface of the topmost recording medium in contact with the pickup roller is the recording surface from which the foreign matter is removed by the remover.

According to this form, even when dust is produced as the foreign matter upon supply of the recording medium from the medium holder to the feeding device, such dust is removed by the remover.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF PREFERRED EMBODIMENTS

Hereinafter, there will be described presently preferred embodiments of the invention with reference to the accompanying drawings.

Referring to FIGS. 1 to 5, there will be described an inkjet recording apparatus according to a first embodiment of the invention which takes the form of an inkjet printer.

Figure 1:
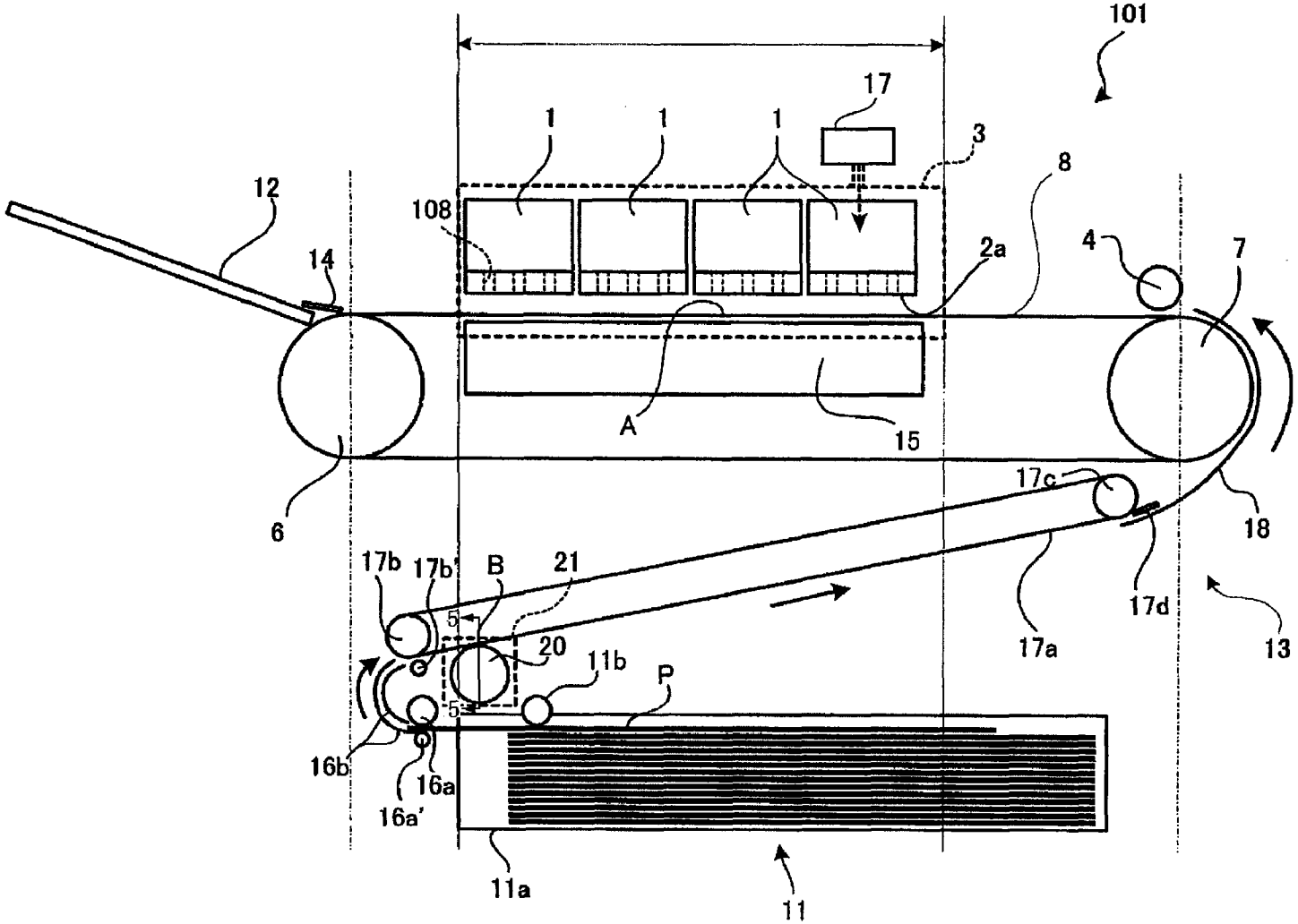
FIG. 1 is a schematic side view of an inkjet printer according to a first embodiment of the invention.

In FIG. 1, reference numeral 101 generally denotes the inkjet printer according to the first embodiment. The inkjet printer 101 has four inkjet heads 1, that is, the inkjet printer is a color printer. Inside the inkjet printer 101 are disposed a sheet supply device 11 as a medium supply device, a remover roller 20 as a remover, a feeding device 13, and a catch tray 12, which 11, 20, 13, 12 are arranged in the order of description along a feed path of a recording medium P, e.g., a cut sheet of paper. The feed path is indicated by solid arrows in FIG. 1.

The sheet supply device 11 includes a sheet holder 11*a* as a medium holder, a pickup roller 11*b*, guide rollers 16*a*, 16*a*', and a pair of guide plates 16*b*, namely, an inner guide plate and an outer guide plate. The guide plates 16*b* function as a first turnover guide. The sheet holder 11*a* accommodates a stack of cut sheets P. The pickup roller 11*b* is driven by a motor (not shown) to sequentially pick up the cut sheets P from inside the sheet holder 11*a* from the topmost sheet P, and feed out the cut sheet P leftward as seen in FIG. 1. The guide rollers 16*a*, 16*a*' and the guide plates 16*b* guide the cut sheet P as fed out by the pickup roller 11*b*, to the feeding device 13 disposed above the sheet supply device 11. More specifically, the cut sheet P as fed out leftward by the pickup roller 11*b* is guided upward by the guide plates 16*b* while being turned over, and then fed rightward. Thereafter, the cut sheet P is fed onto an outer circumferential surface of an intermediate feeder belt 17*a* of the feeding device 13. The outer circumferential surface of the intermediate feeder belt 17*a* functions as a feeding surface and will be so referred to.

The feeding device 13 feeds the cut sheet P as fed out from the sheet supply device 11, and includes the intermediate feeder belt 17*a*, a guide plate 18 as a second turnover guide, a primary feeder belt 8, a platen 15, and a nip roller 17*b*'. The intermediate feeder belt 17*a* is an endless belt wound around two belt rollers 17*b*, 17*c*, and the primary feeder belt 8 is an endless belt wound around two belt rollers 6, 7. The platen 15 is disposed inside a circle formed by the endless feeder belt 8 and opposed to the four inkjet heads 1. At least the feeding surface of the intermediate feeder belt 17*a* is formed of silicone resin, and thus the feeding surface of the intermediate feeder belt 17 has such a tackiness that the cut sheet P fed out from the sheet supply device 11 is nipped between the nip roller 17*b*' and the belt roller 17*b* disposed adjacent to the nip roller 17*b*' in pressed contact to pressure-sensitively adhere to the feeding surface of the intermediate feeder belt 17*a*. The cut sheet P is fed upward and rightward as seen in FIG. 1 in this state, namely, with the cut sheet P adhering to the feeding surface of the intermediate feeder belt 17*a*. While the cut sheet P is thus fed, a recording surface of the cut sheet P faces downward. A separating plate 17*d* is disposed just downstream of the intermediate feeder belt 17*a*, and the cut sheet P having been fed by the intermediate feeder belt 17*a* is detached from the feeding surface of the intermediate feeder belt 17*a* by the separating plate 17*d*.

The cut sheet P as detached from the feeding surface of the intermediate feeder belt 17*a* by the separating plate 17*d* is guided by the guide plate 18 onto an outer circumferential surface, or a feeding surface, of the primary feeder belt 8 disposed above the intermediate feeder belt 17*a*. The feeding surface of the primary feeder belt 8 also has a tackiness. The guide plate 18 is curved along an outer circumferential surface of the belt roller 7. More specifically, the guide plate 18 functions to upward feed the cut sheet P as detached from the feeding surface of the intermediate feeder belt 17*a*, while turning over the cut sheet P, and change the feeding direction from rightward to leftward as seen in FIG. 1. When a front end of the cut sheet P having been detached from the intermediate feeder belt 17*a* reaches a nip roller 4 (described later), a rear end of the cut sheet P still adheres to the intermediate feeder belt 17*a*. Hence, the cut sheet P is fed onto the primary feeder belt 8 with reliability. The nip roller 4 is disposed at a position downstream of the guide plate 18 and adjacent to the belt roller 7. Upon the cut sheet P is guided onto the feeding surface of the primary feeder belt 8 by the guide plate 18, the nip roller 4 presses the cut sheet P against the feeding surface of the primary feeder belt 8. The platen 15 functions to support the primary feeder belt 8 such that a gap between the primary feeder belt 8 and the inkjet heads 1 is held constant at a region where the platen 15 is opposed to the inkjet heads 1.

When a feeder motor (not shown) rotates the belt roller 6, the primary feeder belt 8 circulates and feeds the cut sheet P that is pressed onto the feeding surface thereof by the nip roller 4 and pressure-sensitively adhering thereto. The cut sheet P is thus fed toward the catch tray 12 via an area where the cut sheet P is opposed to the inkjet heads 1.

At a position on the primary feeder belt 8 and near a sheet ejection opening, there is disposed a separating plate 14. The cut sheet P having been fed by the primary feeder belt 8 is detached from the feeding surface of the primary feeder belt 8 by the separating plate 14, and ejected onto the catch tray 12 disposed downstream of the primary feeder belt 8.

The four inkjet heads 1 are for ejecting droplets of respective color inks, i.e., magenta, yellow, cyan, and black inks, and arranged along a feeding direction in which the cut sheet P is fed. That is, the inkjet printer 101 is a line printer. In each of the inkjet heads 1 are formed ink passages each including a nozzle 108 from which an ink droplet is ejected. Each inkjet head 1 is a rectangular parallel-piped long in a direction perpendicular to the feeding direction. An under surface of the inkjet head 1 constitutes an ink ejection surface 2*a* in which the nozzles 108 open. A part of the opposingly-feeding surface of the primary feeder belt 8, is opposed to the ink ejection surfaces 2*a* of the inkjet heads 1, extends along the feed path of the cut sheet P, and corresponds to a recording area A. As the cut sheet P is fed by the primary feeder belt 8 and passes through the recording area A, i.e., just under the four inkjet heads 1, droplets of the respective color inks are ejected from the ink ejection surfaces 2*a* of the inkjet heads 1 toward the recording surface of the cut sheet P, in order to form or record a desired color image within a printing area in the cut sheet P. A recording-area cover 3 is disposed to cover the inkjet heads 1 and a portion of the primary feeder belt 8 corresponding to the recording area A. A positive-pressure keeper 17 is attached to the recording-area cover 3. The positive-pressure keeper 17 keeps positive an internal pressure of the recording-area cover 3. Thus, there is formed an air flow from an internal space of the recording-area cover 3 to an external space thereof, thereby preventing entrance of paper dust and ink mist into the recording-area cover 3.

The remover roller 20 operates to remove the foreign matter, e.g., paper dust, from the recording surface of the cut sheet P being fed by the intermediate feeder belt 17*a*. The remover roller 20 is disposed near an upstream end of the intermediate feeder belt 17*a* at which the cut sheet P is received by the intermediate feeder belt 17*a*. The remover roller 20 contacts a downward-facing surface in the feeding surface of the intermediate feeder belt 17*a*. A planar surface in the downward-facing surface of the feeding surface of the intermediate feeder belt 17*a*, which planar surface is opposed to the remover roller 20, corresponds to a removing area B where the foreign matter is removed from the recording surface of the cut sheet P. An outer circumferential surface of the remover roller 20 has such a tackiness that when the outer circumferential surface of the remover roller 20 contacts the recording surface of the cut sheet P on the downward-facing surface of the feeding surface of the intermediate feeder belt 17*a*, the foreign matter, such as paper dust, on the recording surface is moved away from the cut sheet P onto the remover roller 20. More specifically, the tackiness of the outer circumferential surface of the remover roller 20 is set at a sufficiently small value with respect to the tackiness of the feeding surface of the intermediate feeder belt 17*a*, such that contact between the remover roller 20 and the cut sheet P does not cause detachment of the cut sheet P from the intermediate feeder belt 17*a*. However, this does not necessarily mean that the tackiness of the outer circumferential surface of the remover roller 20 per unit area is smaller than that of the feeding surface of the intermediate feeder belt 17*a*. For instance, the tackiness per unit area may be equal between the outer circumferential surface of the remover roller 20 and the feeding surface of the intermediate feeder belt 17*a*. That is, an area at which the intermediate feeder belt 17*a* contacts the cut sheet P is relatively wide whereas the remover roller 20 contacts the cut sheet P at a partial cylindrical surface which is relatively narrow, and equality in tackiness per unit area between the outer circumferential surface of the remover roller 20 and the feeding surface of the intermediate feeder belt 17*a* does not result in detachment of the cut sheet P from the feeding surface of the intermediate feeder belt 17*a*. However, where the tackiness of the outer circumferential surface of the remover roller 20 per unit area is smaller than that of the feeding surface of the intermediate feeder belt 17*a*, detachment of the cut sheet P from the intermediate feeder belt 17*a* is inhibited with more reliability.

In place of the remover roller 20, other kinds of removers may be employed. For instance, an antistatic brush or an antistatic blower for eliminating static electricity may be employed in place of the remover roller 20.

Figure 2:
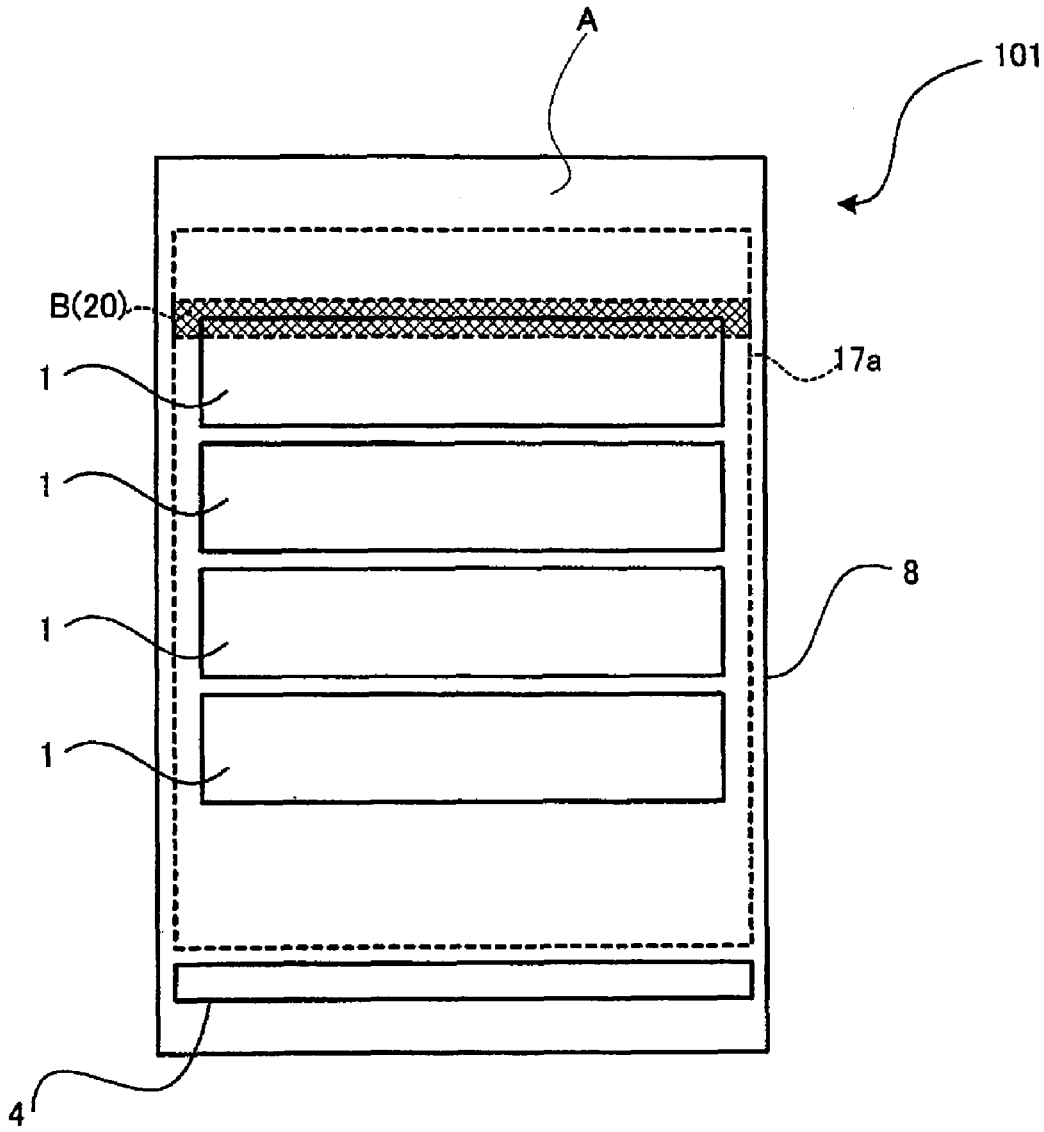
FIG. 2 is a schematic top view of the inkjet printer.
Figure 3:
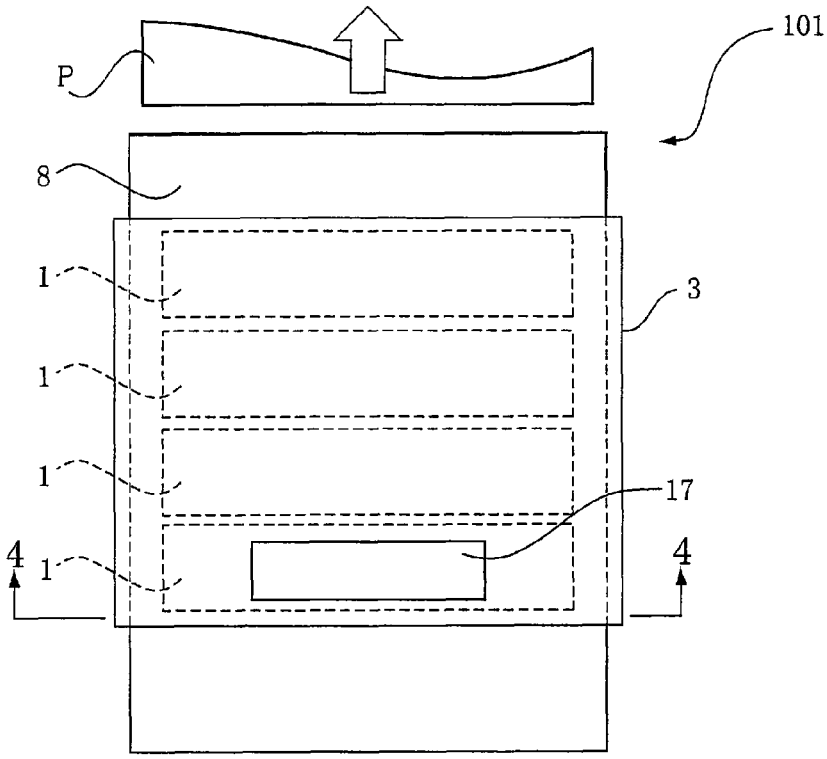
FIG. 3 is a top plan view of a relevant part of the inkjet printer.
Figure 4:
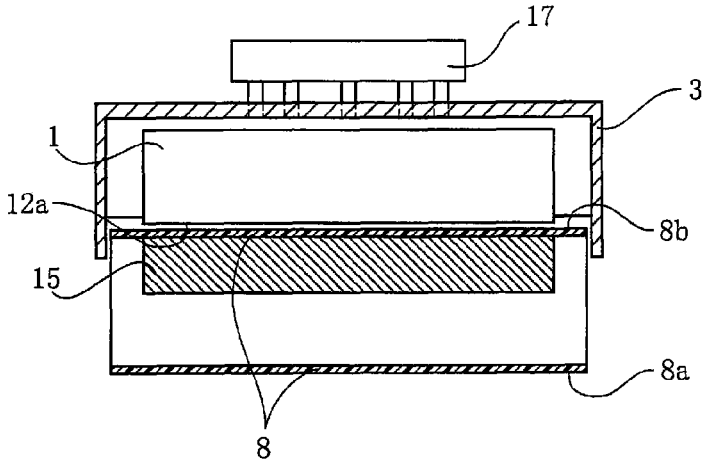
FIG. 4 is a cross-sectional view taken along line 4-4 in FIG. 3.
Figure 5:
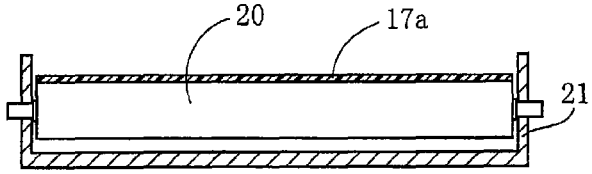
FIG. 5 is a cross-sectional view taken along line 5-5 in FIG. 1.

The removing area B is located under an "opposingly-feeding surface" in the feeding surface of the primary feeder belt 8. The opposingly-feeding surface includes or encompasses the recording area A, and extends along the feed path of the cut sheet P. The opposingly-feeding surface is a planar surface having a greatest area among all the planar surfaces included in the feeding surfaces of the primary feeder belt 8 and the intermediate feeder belt 17*a*. As FIG. 2 shows, the remover roller 20 and the removing area B are disposed within an area corresponding to the primary feeder belt 8, specifically, within the opposingly-feeding surface of the primary feeder belt 8, as seen from the upper side or in a vertical direction. Further, a removing-area cover 21 (shown in cross section in FIG. 5) is disposed to cover the remover roller 20 and a part of the intermediate feeder belt 17*a* which part extends across, or to include, the removing area B. The disposition of the removing-area cover 21 prevents scattering of the foreign matter that departs from the recording surface of the cut sheet P upon the removal of the foreign matter from the recording surface. The removing area B may be disposed outside of a vertical projection of the recording area A. Further, although not shown, an internal pressure of the removing-area cover 21 may be made negative by a suction device, in order to reliably prevent the scattering of the foreign matter as departing from the cut sheet P.

As described above, the cut sheet P is fed out by the pickup roller 11*b*, leftward as seen in FIG. 1 from the sheet holder 11*a*. As the cut sheet P goes upward while guided by the guide rollers 16*a*, 16*a*' and the guide plates 16*b* thereafter, the cut sheet P turns over. Then, the cut sheet P is fed rightward as seen in FIG. 1 into the feeding device 13, in which the cut sheet P is fed upward and rightward while pressure-sensitively adhering to the feeding surface of the intermediate feeder belt 17*a* with the recording surface thereof facing downward. At the removing area B, which is near the upstream end of the intermediate feeder belt 17*a*, the foreign matter on the recording surface is removed by the remover roller 20. After fed by the intermediate feeder belt 17*a*, the cut sheet P is detached from the feeding surface of the intermediate feeder belt 17*a* by the separating plate 17*d*. The cut sheet P is then guided upward by the guide plate 18 while being turned over and changing its feeding direction from rightward to leftward as seen in FIG. 1, so that the cut sheet P is put onto the feeding surface of the primary feeder belt 8. During the cut sheet P is fed on the feeding surface of the primary feeder belt 8, the cut sheet P passes just under the four inkjet heads 1, i.e., the recording area A, where droplets of the color inks are ejected from the ink ejection surfaces 2*a* toward the recording surface of the cut sheet P to form or record a desired color image within the printing area of the cut sheet P. Then, the cut sheet P is detached from the feeding surface of the primary feeder belt 8 by the separating plate 14, and ejected onto the catch tray 12 on the left side of the primary feeder belt 8 as seen in FIG. 1. Thus, the feed path formed in the inkjet printer 101 is S-shaped in side view.

As illustrated above, in the present embodiment the removing area B is disposed under the primary feeder belt 8 and within the area corresponding to the primary feeder belt 8 as seen in the vertical direction. Hence, the foreign matter, which has scattered from the recording surface of the cut sheet P upon the removal of the foreign matter from the recording surface and wafts, is inhibited from entering a clearance between the primary feeder belt 8 and the ink ejection surfaces 2*a*. Therefore, the wafting foreign matter is reliably inhibited from landing on the ink ejection surfaces 2*a*.

Since the whole remover roller 20 is disposed within the area corresponding to the primary feeder belt 8 as seen in the vertical direction, the inkjet printer 101 can be downsized.

The recording surface of the cut sheet P does not once face vertically upward at the segment between the removing area B and the primary feeder belt 8, that is, after the cut sheet P has passed the removing area B and before the cut sheet P is placed on the primary feeder belt 8. Thus, the foreign matter, e.g., paper dust, that has been once removed does not tend to land back on the cut sheet P. Hence, landing of foreign matter on the ink ejection surfaces 2*a* via the cut sheet P is reliably inhibited.

Since the inkjet heads 1 and the portion of the primary feeder belt 8 corresponding to the recording area A are covered by the recoding-area cover 3, landing of foreign matter on the ink ejection surfaces 2*a* is further reliably inhibited.

Since the remover roller 20 and the part of the intermediate feeder belt 17*a* corresponding to the removing area B are covered by the removing-area cover 21, the foreign matter departing from the recording surface of the cut sheet P is prevented from scattering around.

Figure 6:
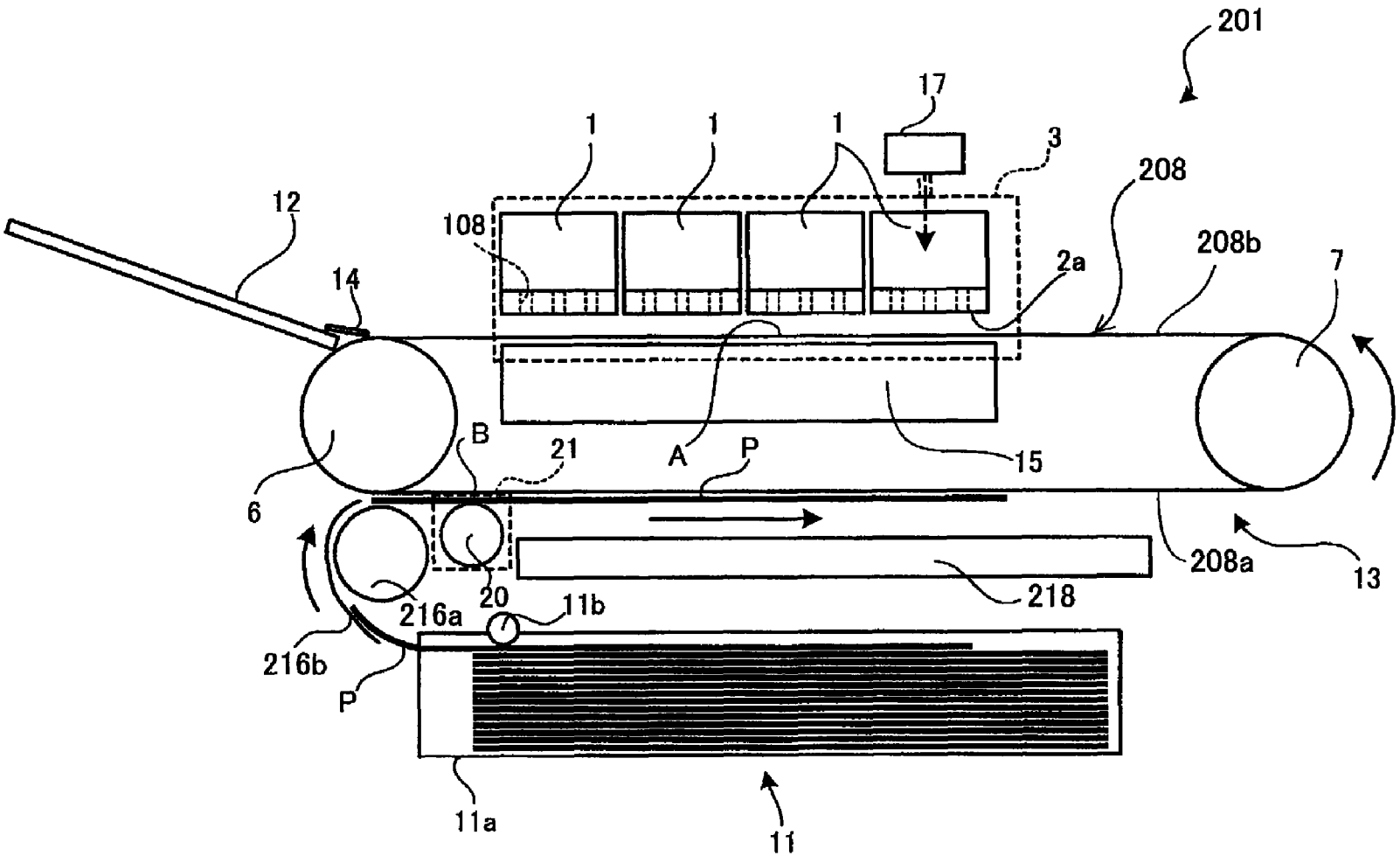
FIG. 6 is a schematic side view of an inkjet printer according to a second embodiment of the invention.

Although in the above-described embodiment, the feed path in the inkjet printer 101 along which the cut sheet P is fed is S-shaped in side view, the feed path may have other shapes. For instance, the feed path may be U-shaped. Hereinafter, there will be described an inkjet printer 201 according to a second embodiment of the invention, in which the feed path is U-shaped, by referring to FIG. 6.

In the second embodiment, the intermediate feeder belt 17*a* used in the first embodiment is omitted, and a cut sheet P as turned over or turned 180-degree by a turnover guide plate 216*b* is made to pressure-sensitively adhere to a downward-facing surface 208*a* of a feeder belt 208.

In the first embodiment, the cut sheet P is guided and turned over by a pair of guide plates 16*b*, namely, an outer guide plate and an inner guide plate. In the second embodiment, on the other hand, the inner guide plate 16*b* is omitted and a guide roller 216*a* having a relatively large diameter is employed, and the cut sheet P is guided by an outer circumferential surface of the guide roller 216*a* and the guide plate 216*b*.

Further, a dust tray 218 is disposed between the downward-facing surface 208*a* of the feeder belt 208 and the sheet holder 11*a*. More specifically, the dust tray 218 is disposed above a topmost one of a stack of cut sheets P accommodated in the sheet holder 11*a*, with a clearance between the dust tray 218 and the topmost cut sheet P. The dust tray 218 has such a size as to cover almost an entire upper surface of the topmost cut sheet P. Hence, dust wafting inside the inkjet printer 201 is effectively prevented from accumulating on the upper surface of the topmost cut sheet P.

The other parts of the second embodiment are identical with the first embodiment and description thereof is omitted.

Although two presently preferred embodiments of the invention have been described above, the invention is not limited to details thereof, but may be otherwise embodied with various modifications which do not depart from the scope and spirit of the invention as defined in the appended claims.

For instance, although in each of the above-described embodiments the whole remover (namely, remover roller 20) is disposed within the area corresponding to the primary feeder belt 8, or the feeder belt 208, as seen in the vertical direction. However, at least a part of the remover may be outside the area corresponding to the primary feeder belt 8 or the feeder belt 208 as seen in the vertical direction.

In the first embodiment, the feed path along which the cut sheet P is fed is constructed such that the recording surface of the cut sheet P does not once face vertically upward at the segment of the feed path between the removing area B and the primary feeder belt 8. Similarly, in the second embodiment, the feed path is constructed such that the recording surface does not once face vertically upward at a segment of the feed path between the removing area B and the opposingly-feeding surface 8*b* of the feeder belt 208. However, the feed paths may be constructed such that the recording surface of the cut sheet P faces vertically upward somewhere in these segments.

In each of the above-described embodiments, the recording-area cover 3 covers only the inkjet heads 1 and a part of the primary feeder belt 8, or the feeder belt 208, which part includes the portion corresponding to the recording area A. However, the recording-area cover 3 may further cover a surface of the primary feeder belt 8 or the feeder belt 208 which surface includes the recording area A, and also another area over the surface. Alternatively, the recording-area cover 3 may be omitted.

In each of the above-described embodiments, the removing-area cover 21 covers only the remover roller 20 and a part of the intermediate feeder belt 17*a*, or the feeder belt 208, which part includes the portion corresponding to the removing area B. However, in the first embodiment, the removing-area cover 21 may further cover another area of the feeding surfaces except the opposingly-feeding surface in the primary feeder belt 8 which surface includes the recording area A. For instance, the removing-area cover 21 may cover substantially the whole intermediate feeder belt 17*a*. Similarly, in the second embodiment, the removing-area cover 21 may further cover another area of the feeder belt 208 except the opposingly-feeding surface including the recording area A. Alternatively, the removing-area cover 21 may be omitted in each of the above-described embodiments.

In each of the above-described embodiments, the endless belt 17*a*, 8, 208 constructs a part of the feed path of the cut sheet P. However, in place of the endless belt, rollers or guide plates may be employed to construct the feed path.

As in the above-described embodiments, the cut sheet P as a recording medium can be easily held on the outer circumferential surface or feeding surface of each feeder belt 17*a*, 8, 208, when the feeding surface has a tackiness. However, the way in which the cut sheet P is held on the feeding surface is not limited thereto. For instance, it may be arranged such that the feeder belt 17*a*, 8, 208 is formed of a material having an air permeability, and the air is sucked through the feeder belt 17*a*, 8, 208 from the inner circumferential side of the belt 17*a*, 8, 208 in order to hold the cut sheet P on the feeding surface.

Although each of the above-described inkjet printers 101, 201 is a line printer, the invention is applicable to other types of inkjet printers, such as serial printer.

What is claimed is:

1. An inkjet recording apparatus comprising:

a feeding device which feeds a recording medium along a feed path passing through a removing area and extending along an opposingly-feeding surface facing upward, the removing area being located under the opposingly-feeding surface and within the opposingly-feeding surface as seen in a vertical direction;

a remover which removes foreign matter from a surface of the recording medium during the recording medium is fed through the removing area by the feeding device;

an inkjet head disposed downstream of the remover with respect to a feeding direction in which the recording medium is fed, the inkjet head having an ink ejection surface in which a nozzle is open, an ink droplet being ejected from the nozzle toward a recording surface of the recording medium while the recording medium is fed along at least a part of the opposingly-feeding surface which part is opposed to the ink ejection surface; and a medium supply device which sequentially supplies a topmost recording medium from a stack of recording media, the medium supply device comprises a medium holder which accommodates the stack of recording media, and wherein the recording surface from which the remover removes the foreign matters is an upper surface of the topmost recoding medium from the stack of recording media, wherein the feeding device comprises:

at least one primary feeder belt which feeds the recording medium to a recording area with the recording medium held on an outer circumferential surface of the primary feeder belt which functions as a feeding surface, the recording medium being opposed to the ink ejection surface of the inkjet head at the recording area; and an intermediate feeder belt which receives the recording medium from the medium supply device onto an outer circumferential surface thereof which functions as a feeding surface, and feeds the recording medium with the recording medium held on the feeding surface of the intermediate feeder belt, the intermediate feeder belt then giving the recording medium to the primary feeder belt, and wherein the remover comprises a remover roller an outer circumferential surface of which has a tackiness and contacts a downwardly-facing portion of the feeding surface of one of the at least one primary feeder belt such that the remover roller rotates with circulation of the at least one feeder belt.

2. The inkjet recording apparatus according to claim 1, wherein the opposingly-feeding surface is a planar surface which has a greatest area among all the planar surfaces extending along the feed path.

3. The inkjet recording apparatus according to claim 1, wherein the whole remover is located within the opposingly-feeding surface as seen in the vertical direction.

4. The inkjet recording apparatus according to claim 1, wherein the opposingly-feeding surface is horizontal, and the recording surface of the recording medium does not once face vertically upward at a segment of the feed path between the removing area and the opposingly-feeding surface.

5. The inkjet recording apparatus according to claim 1, further comprising a recording-area cover which covers at least the inkjet heads and a portion of the opposingly-feeding surface which portion is opposed to the ink ejection surface of the inkjet head.

6. The inkjet recording apparatus according to claim 5, further comprising a positive-pressure keeper which holds positive an internal pressure of the recording-area cover.

7. The inkjet recording apparatus according to claim 1, further comprising a removing-area cover which covers at least the remover and the removing area.

8. The inkjet recording apparatus according to claim 1, wherein each of the at least one primary feeder belt is wound around two belt rollers that are rotatable around respective rotation axes that are parallel to each other.

9. The inkjet recording apparatus according to claim 1, wherein the feeding surface of the one of the at least one primary feeder belt has a tackiness which enables the holding of the recording medium on the feeding surface.

10. The inkjet recording apparatus according to claim 9, further comprising a pair of nip rollers that nip therebetween the recording medium and the one of the at least one primary feeder belt from opposite sides in order that the recording medium pressure-sensitively adheres to the feeding surface of the one of the at least one primary feeder belt.

11. The inkjet recording apparatus according to claim 10, wherein one of the nip rollers is one of the belt rollers around which the at least one primary feeder belt is wound.

12. The inkjet recording apparatus according to claim 1, wherein the remover removes the foreign matter on the surface of the recording medium while the recording medium is fed by the intermediate feeder belt.

13. The inkjet recording apparatus according to claim 1, wherein the medium supply device supplies in a substantially horizontal direction the stack of the recording media placed on a supporting surface which is substantially horizontal, the opposingly-feeding surface is substantially horizontal, and the feed path is curved in an S-like shape.

14. The inkjet recording apparatus according to claim 1, further comprising a turnover guide disposed between the medium supply device and the intermediate feeder belt and guides the recording medium supplied from the medium supply device, to the intermediate feeder belt, in a U-turn manner to turn over the recording medium, and wherein the remover is disposed between the medium supply device and the intermediate feeder belt in the vertical direction.

15. The inkjet recording apparatus according to claim 14, wherein the intermediate feeder belt is disposed between the primary feeder belt and the medium supply device in the vertical direction, and inclined such that a portion of the intermediate feeder belt adjacent to the turnover guide is near the medium supply device and another portion of the intermediate feeder belt apart from the turnover guide is near the primary feeder belt.

16. The inkjet recording apparatus according to claim 14, further comprising a second turnover guide which is another turnover guide than said turnover guide as a first turnover guide, and disposed between the intermediate feeder belt and the primary feeder belt, the second turnover guide guiding the recording medium as having been fed by the intermediate feeder belt, to the primary feeder belt in a U-turn manner to turn over the recording medium.

17. The inkjet recording apparatus according to claim 1, wherein the medium supply device further includes:

a pickup roller which rotates in contact with a surface of a topmost one of the stack of the recording media in the medium holder in order to supply the topmost recording medium, the surface of the topmost recording medium in contact with the pickup roller is the recording surface from which the foreign matter is removed by the remover.

18. The inkjet recording apparatus according to claim 1, wherein the medium supply device further includes:

a pickup roller which rotates in contact with a topmost one of the stack of the recording media in the medium holder in order to supply the topmost recording medium, the inkjet recording apparatus further comprising a dust tray which is disposed apart from an upper surface of a topmost one of the stack of the recording media in the medium holder in order to cover the upper surface of the topmost recording medium.

19. The inkjet recording apparatus according to claim 14, wherein the turnover guide is disposed on an upstream side of a position at which the remover contacts the intermediate feeder belt.

* * * * *